United States Patent [19]

Huang

[11] Patent Number: 5,044,627

[45] **Date of Patent: * Sep. 3, 1991**

[54] MULTI-FUNCTIONAL STATIONARY BIKE FOR GYMNASTIC PURPOSE

[76] Inventor: Gwo-Ming Huang, No. 181, Lane 412, Chenhsing Rd., Taichung, Taiwan

[ * ] Notice: The portion of the term of this patent subsequent to Jun. 27, 2006 has been disclaimed.

[21] Appl. No.: 470,072

[22] Filed: Jan. 25, 1990

[51] Int. Cl.[5] ..... A63B 21/00

[52] U.S. Cl. ..... 272/73; 272/132

[58] Field of Search ..... 272/73, 132; 74/31

[56] References Cited

U.S. PATENT DOCUMENTS

| | | | |
|---|---|---|---|
| 3,572,699 | 3/1971 | Nies | 272/73 |
| 3,865,366 | 2/1975 | Stantial | 272/73 |
| 4,618,141 | 10/1986 | Ashworth | 272/73 |
| 4,688,791 | 8/1987 | Long | 272/73 |
| 4,842,269 | 6/1989 | Huang | 272/73 |

*Primary Examiner*—Stephen R. Crow

*Attorney, Agent, or Firm*—Leonard Bloom

[57] ABSTRACT

A multi-functional stationary bike for gymnastic purpose. A hand-exercise mechanism is mounted above a bike frame and a foot-exercise mechanism is mounted under the bike frame. The hand-exercise and foot-exercise mechanism include respective base and gear mechanisms, wherein the gear mechanism can rotate and roll along the base by use of a gear and several bearings. The hand-exercise and foot exercise mechanism are thus allowed to do reciprocal motions in forward, rearward, upward and downward directions simultaneously, whereby the users may receive an adequate full-body exercise.

6 Claims, 4 Drawing Sheets

MULTI-FUNCTIONAL STATIONARY BIKE FOR GYMNASTIC PURPOSE

FIELD OF THE INVENTION

The present invention relates to a multi-functional gymnastic bike, and more particularly, to a gymnastic bike that is easy to manufacture, and assemble and which provides the user thereof with a full-body exercise.

BACKGROUND OF THE INVENTION

In the art of conventional gymnastic bikes, the motion of pedalling a bike occurs by holding a stationary handle with the hands and pedalling the pedals with the feet in circular motions, whereby parts of the user's legs are exercised. If desired, the handles may be pulled or pushed for providing stretching motions. However, conventional gymnastic bikes are equipped so as to have either a rotational motion around the stationary shaft or a stretching motion by use of the handles only, such that a simultaneous pedalling exercise for both the hands and feet is not allowed. In order to improve the functioning of conventional gymnastic bikes, the applicant disclosed in U.S. Pat. No. 4,842,269 and European Patent Application Serial No. 88311021.5 entitled "Multi-functional Stationary Bike for Gymnastic Purpose", a bike mounting that is equipped with an exercise mechanism for the handles and a motion mechanism for the foot pedals. In this fashion, the user is able to receive a full body exercise through laterally reciprocating circular motions that are produced by the hand-exercise mechanism, and longitudinally reciprocating circular motions that are produced by the foot-exercise mechanism. However, the hand-exercise and foot-exercise mechanisms are complicated being comprised of multiple members that are not convenient for assembly and disassembly thereof, and that are expensive to produce and process. This design shall be improved further, so as to enable the gymnastic bike to be more widely used.

SUMMARY OF THE INVENTION

The primary object of the present invention is to provide a multi-functional stationary gymnastic bike that provides the users thereof with a full body exercise.

Another object of the present invention is to provide a multi-functional gymnastic bike that is simple to assemble and disassemble and that is easy to process and manufacture.

These and other objects and advantages of the present invention will become apparent from a reading of the following specification, taken in conjunction with the enclosed drawings.

DESCRIPTION OF THE PREFERRED EMBODIMENTS

Figure 1:
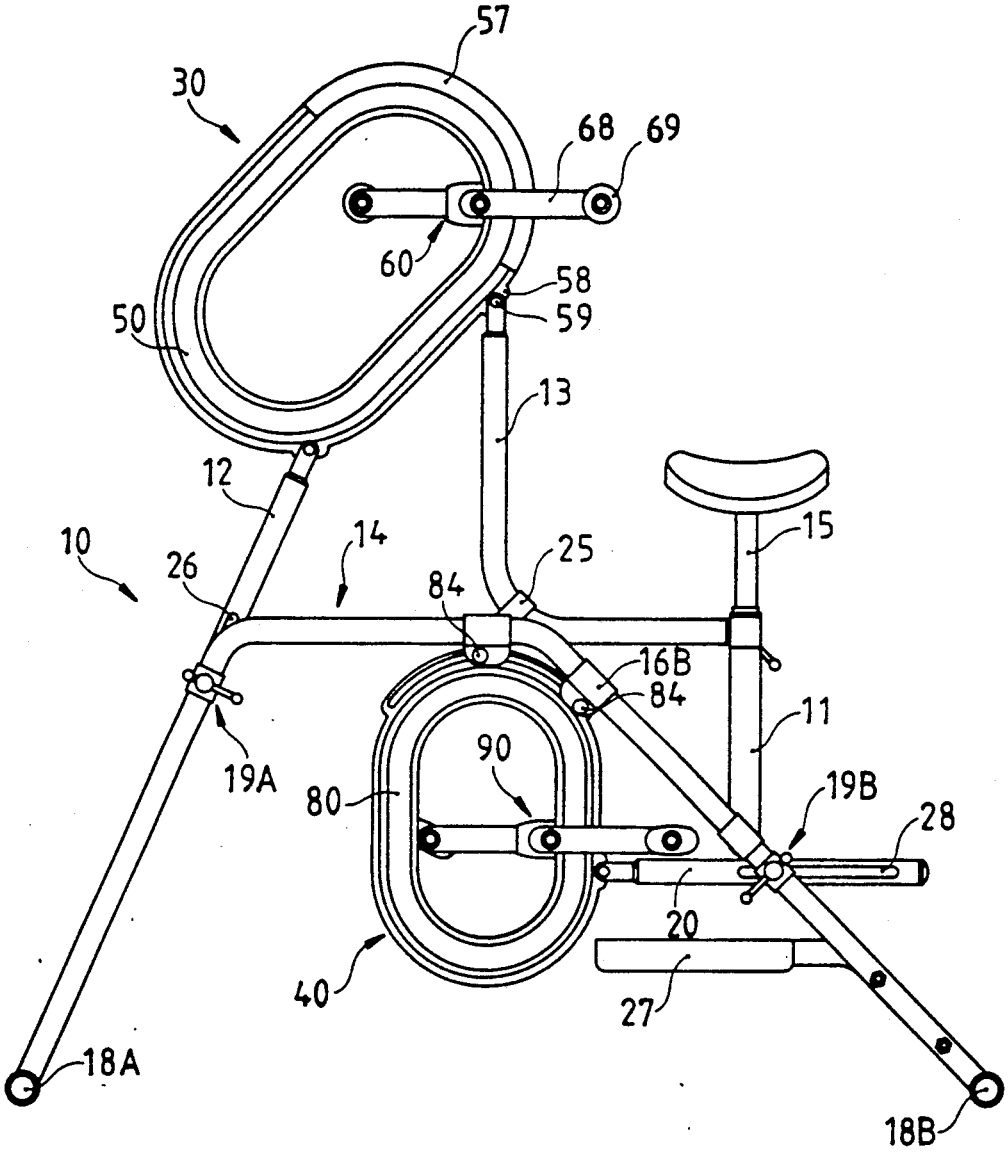
FIG. 1 is a front view of the present invention.

Referring now to the drawings, the multi-functional bike 1 of the present invention includes a bike frame 1, a seat tube 15, a hand-exercise mechanism 30 and a foot-exercise mechanism 46. The seat tube 15 is mounted at the upper end of the rear section 11 of the bike frame 10 and is adjustable in height. The hand-exercise mechanism 30 is laterally mounted at the upper end of the middle section 13 and the front section 12 of the bike frame 10. The foot-exercise mechanism 40 is longitudinally mounted under a main body 14 of bike frame 10. Reciprocating exercises generated from use of the hand-exercise and foot-exercise mechanisms 30 and 40 enable the user to receive a full-body exercise.

Figure 2:
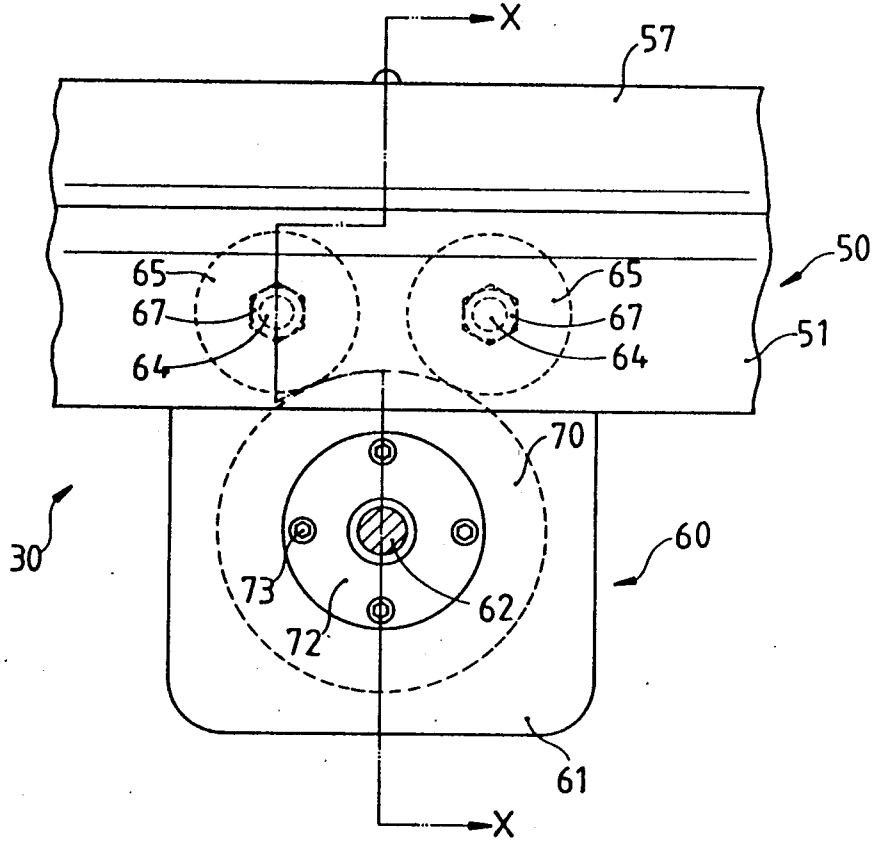
FIG. 2 is a partial front view of the hand-exercise mechanism.

The hand-exercise mechanism 30 comprises a hand-exercise base 50 and a hand-driven gear mechanism 60 (See FIG. 1). The hand-exercise base 50 is laterally fixed at the upper ends of the from section 12 and the middle section 13 of the bike frame 10. The base 50 has a pair of elliptic rings 51 and a rack 52. The sectional surface of each elliptic ring 51 resembles a C shape, with one end that extends outward vertically. The rack 52 resembles an elliptic ring plate shape, having one end that is equipped with gear teeth and both sides of which have a plurality of protuberances 53 formed thereon. The protuberances 53 are adapted to be attached with two positioning ring plates 54, each of which, in cross-section resembles an L shape. Each ring plate 54 has a plurality of holes 55 formed therein to accommodate the protuberances 53. The elliptic rings 51, the rack 52 and the ring plates 54 are attached tightly by several bolts 56, whereby the sectional surface of said hand-exercise base 50 is in a rectangular shape having a vertical line bisecting the rectangle (See FIG. 2. 3). The rim at the rear side of the hand-exercise base 50 is integral with an arc cover body 57. The sectional surface of the cover body 57 resembles a U shape, having appropriate elasticity for covering the junction of the hand-exercise base 50. Assembly is convenient and provides better safety. The outer margin of the hand-exercise base 50 is equipped with two convex (flanges) 68 that connect the base 50 to, respectively, the front section 12 and the middle section 13 of the bike frame 10 by means of respective bolts 59 that are disposed therethrough. In this manner, the hand-exercise mechanism 50 is vertically-adjustably mounted on the bike frame 1, so that the vertical positioning of the mechanism 50 on the frame 1 may be selectively adjusted.

Figure 3:
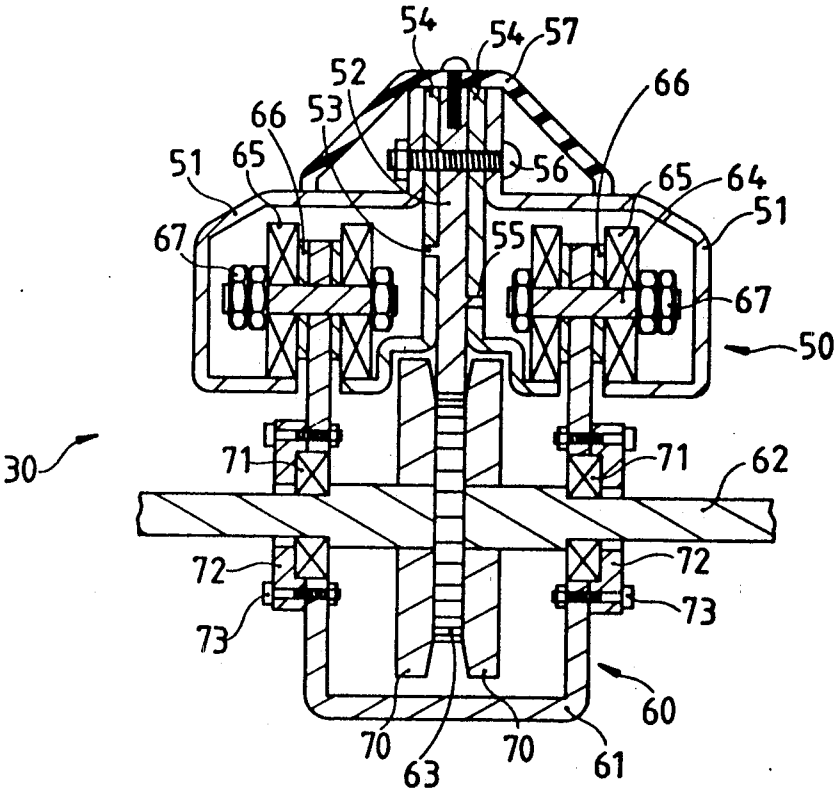
FIG. 3 is a sectional view take along the lines X—X of FIG. 2., showing a layout of the hand-exercise mechanism.

The hand-driven gear mechanism 60 is geared (meshes with) to the rack 52 of the hand-exercise base 50, whereby it can move up and down reciprocally along the inner marginal face of the hand-exercise base 50. The hand-driven gear mechanism 60 includes a housing body 61, a pivot 62 and a gear 63 that is driven by the pivot 62. The housing body 61 resembles an uncovered rectangular box. The diameter of that portion of the pivot 62 that is located inside the housing body 61 is larger than that portion of the pivot 62 that is located outside of the housing body 61. Two long bolts 64 are mounted through two lateral walls at the opening end of the housing body 61 at the same level. Both ends of each of the long bolts 64 carries a bearing 65, a washer 66 and nuts 67 thereon for positioning the bearing 65. When the hand-exercise mechanism 30 is involved in reciprocating motions, each bearing 65 rolls along the hand-exercise base 50, so as to provide supporting force and balance functions. The pivot 62 penetrates through the housing body 61, and each end is pivoted with a respective crank 68. The two cranks 68 move upward and downward counterly and each end has a handle (hand pedal) 69. The gear 63 is mounted in the housing body 61 and is frictionally fitted on pivot 62. On both opposite sides of the pivot 62 are respective guard plates 70 is attached and a respective bearing 71 is inserted in the lateral wall of the housing body 61. The gear 63, guard plates 69 and bearings 71 all are penetrated by and disposed on the pivot 62. Each guard plate 69 has a greater outer diameter than that of the gear 63, whereby the gear 63 is guided precisely gearing with the rack 52 of the hand-exercise base 50 (See FIG. 3). Each bearing 71 is externally covered by an annular plate 72 which has an U-shaped section and that tightly clamps the outer race of the bearing 71. Each annular plate 72 is screwed to the housing body 61 by bolts 73 that are received through the edge of the plate 72.

The hand-driven gear mechanism 60 is geared on the hand-exercise base 50, whereby the gear 63 is geared with the rack. In this fashion, the bearing 65 and the gear 63 frictionally roll on the inner wall of the elliptic ring 51 and the transverse portion of the plate 54 clamps and rolls up and down on the inner side of the hand-exercise base 60 by means of a matching multi-point contact (meshing of respective teeth) of gear 63 and bearing 65. The hand-driven gear mechanism 60 will produce reciprocal circulating motions in forward and reverse directions (subject to the direction of rotation of the crank) accompanying the rotation of the crank 68 when the hand-exercise mechanism 30 is used.

For assembling the hand-exercise mechanism 30, the pair of guard plates 70 and the gear 63 are set into the housing body 61. Then, the pivot 62 is inserted through the housing body 61 to position the guard plates 70 and gear 63. The bearing 71 is then inserted into the lateral wall of the housing body 61 for positioning the pivot 62. Next, the plates 72 are fixed to cover the mechanism 30. Finally, mounting of each long bolt 64 through the lateral wall of the housing body 61 positions the bearings 65, the washers 66 and the nuts 67 on each long bolt 64 in sequence, whereby the assembly of the hand-driven gear mechanism 60 is completed.

Each ring plate 54 is set between the bolts 64 and move sideward to provide a support for the bearing 65, and to insert the gear teeth of the rack 52 between the guard plates 70 of the hand-driven gear mechanism 60, so as to precisely mesh with the gear 63. Each elliptic ring 51 abuts the bearing 65 on the external side of the hand-driven gear mechanism 60 from both sides, whereby each bearing 65 is held against the inner wall of each elliptic ring 51 to lock each elliptic ring 51, ring plate 54 and rack 52 thereof. Each end of the pivot 62 is connected with the crank 67 and the handle 68 respectively, whereby the assembly of the hand-exercise mechanism 30 is completed. The hand-exercise mechanism 30 is not only very easy to mount and dismount for assembly and disassembly but also is very convenient to manufacture and maintain. In addition, with multi-point firm assembly between the hand-exercise base 50 and the hand-driven gear mechanism 60, the hand-exercise mechanism becomes more advantageous to use.

Figure 4:
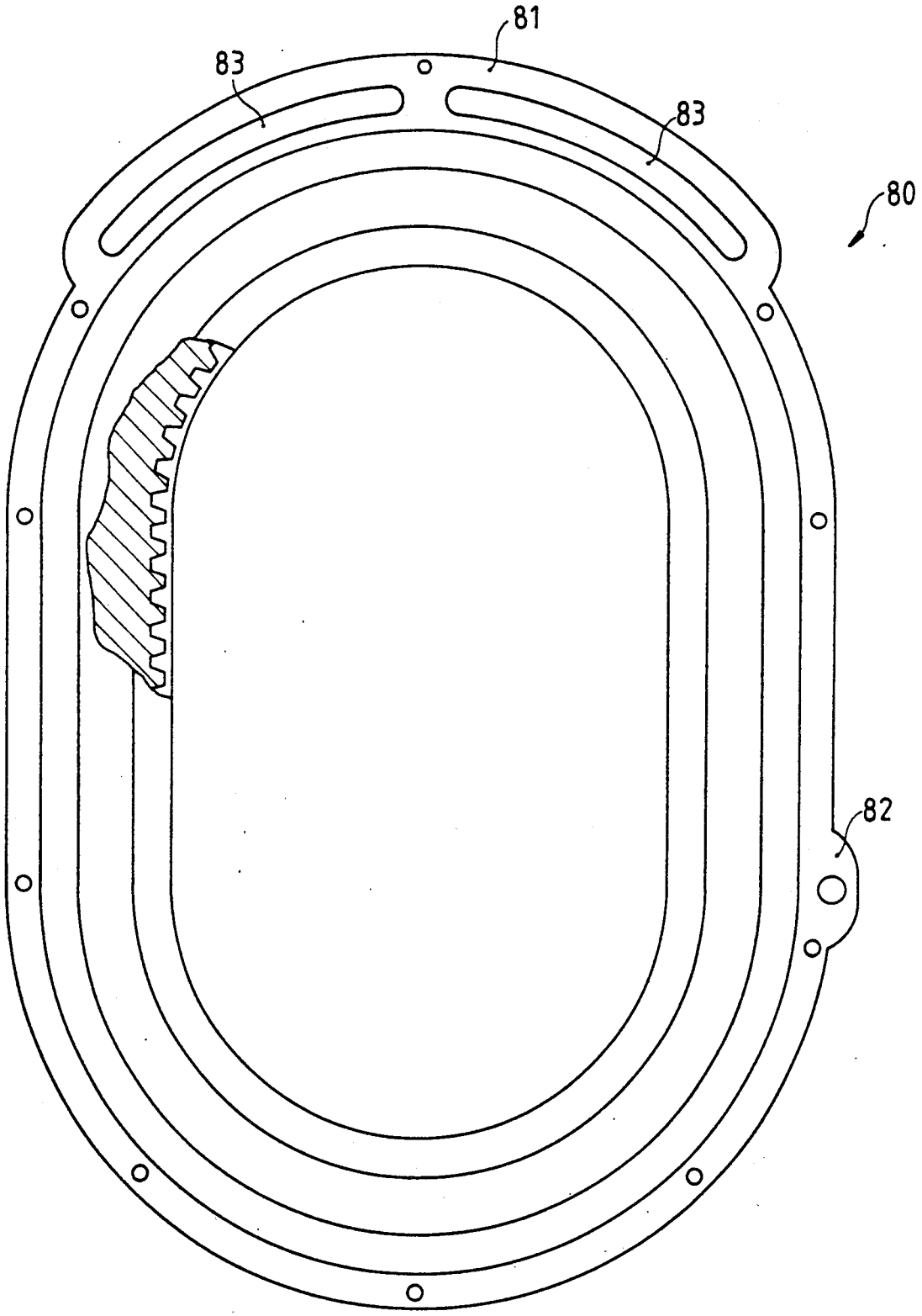
FIG. 4 is a partial view of the foot-exercise base.

The foot-exercise mechanism 40 is longitudinally mounted under the middle section 13 of the bike frame 10, comprising a foot-exercise base 80 and a foot-driven gear mechanism 90 (See FIG. 1). The structure of the foot-exercise mechanism 40 is similar to that of the hand-exercise mechanism 30, except that the foot-exercise base 80 has an arc connection plate 81 at the top edge and a convex 82 at the lateral margin (See FIG. 4). The connection plate 81 is equipped with two arc holes 83 along the circular direction, whereby said foot-exercise base 80 is substantially longitudinally adjustably connected (mounted) substantially vertical under the main body 14 of the bike frame 10 by means of mounting connection elements 84 (such as pin, bolt, screw, etc.). In this manner, the foot-exercise mechanism 40 is longitudinally-adjustably mounted on the bike frame, so that the longitudinally positioning of the foot-exercise mechanism on the bike frame may be selectively adjusted.

By means of the assembly of the elements, the foot-driven gear mechanism 90 of the foot-exercise mechanism 40 may be moved relative to the user to do reciprocal movement either in a long or in a short distance through the rotation of the pair of cranks 68. In this manner, the user can do an exercise for the muscle and joints of hands, neck and waist. The foot-driven gear mechanism 90 of said foot-exercise mechanism 40 may be moved relative to the user to do reciprocal motions through the rotation of the cranks. In this manner, the user can do an exercise for the muscle and joints of the feet.

Figure 5:
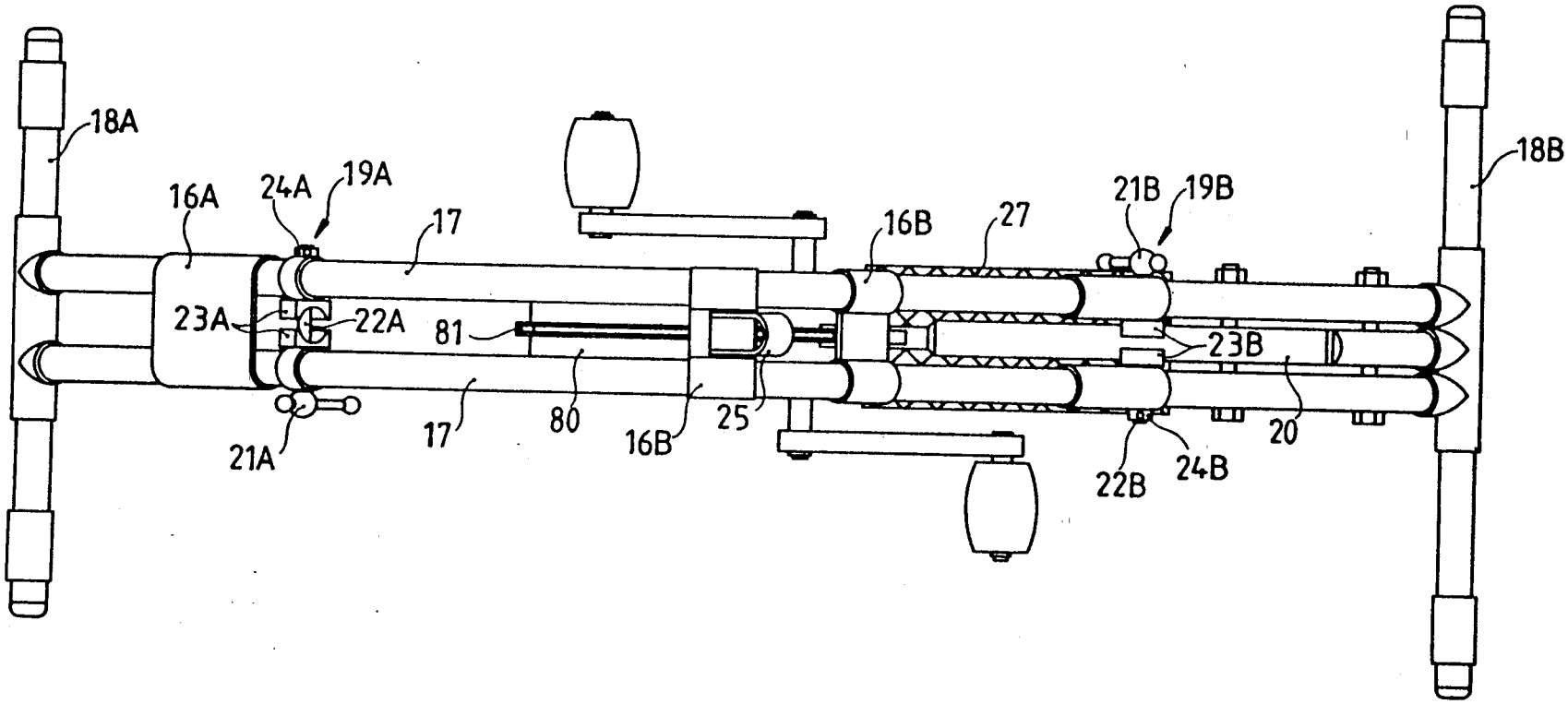
FIG. 5 is a top view of said bike frame, wherein the front section, middle section and rear section have been removed therefrom for the sake of clarity.

The main body 14 of said bike frame 10 resembles an inverted U, including a front guard casing 16.A, and several tube clamps 16.B that clamp a pair of bent tubes 17 in parallel vertical type seat tubes 18.A and 18.B are, respectively, locked at each end of the pair of bent tubes 17 (See FIG. 5). Two adjusting members 19.A and 19.B are laterally mounted on said main body 14 for clamping the front section 12 and an adjusting rod 20, wherein each of the adjusting members 19.A and 19.B has a rotational handle 21.A (21.B), a long bolt 22.A (22.B) laterally disposed through each bent tube 17, a pair of concave flexible blocks 23.A (23.B) and a nut 24.A (24.D). Rotation of the rotational handles 21.A, 21.B controls the flexible blocks 23.A, 23.B to clamp the front section 12 and the adjusting rod 20 in different tightness and to adjust the obliquity of the exercise mechanism 20, 40, so that it is very convenient to operate. A casing ring 25 is obliquely mounted on the tube clamp 16.B on top end of said main body 14 for inserting and positioning the L-shaped middle section 13.

The front section 12 and the middle section 13 of the bike frame are respectively pivoted with the convex 58 of the hand-exercise base 50. The middle section 13 is connected with the convex 58 at one end and at the other end thereof is vertically connected with the rear section 11. A long hole 26 is radially formed through the front section 12 for adjusting and positioning therein the long bolt 22 of the adjusting member 19.A. In this manner, the hand-exercise base 50 can obtain different angle of altitude/depression to allow the user to receive an upper-body exercise. In addition, the adjusting rod 20, for extension adjustment, and a pedal stand 27 are pivoted at the rear side of the main body 14 of said bike frame 10. This adjusting rod 20 is laterally pivoted with the convex 82 of the foot-exercise base 80, which is radially formed with a long hole 28 through for adjustably receiving and positioning therein the long bolt 22.B of the adjusting member 19.B. In this manner, the foot-exercise base 80 can obtain different angle of swing to allow the user to do lower-body exercises by means of fitting with the adjusting rod 20 and the arc connection plate 81.

With reference to above-said description, this multi-functional stationary bike of the present invention is not only easy to assemble and disassemble but is also convenient to maintain. More specifically, it can provide the users thereof with a full-body exercise.

Obviously, many modifications may be made without departing from the basic spirit of the present invention. Accordingly, it will be appreciated by those skilled in the art that within the scope of the appended claims, the invention may be practised other than has been specifically described herein.

What is claimed is:

1. A multi-functional stationary bike for gymnastic purpose, comprising:

a bike frame having an upper end, the bike frame including a front section having upper ends, the front section being adjustable in length, a middle section, a rear section and a main body;

a seat tube mounted at the upper end of the bike frame;

a hand-exercise mechanism laterally mounted at the upper ends of the front section and the middle section of the bike frame, the hand exercise mechanism including a hand-exercise base and a hand-driven gear mechanism;

a foot-exercise mechanism longitudinally mounted under the main body of the bike frame, the foot-exercise mechanism including a foot-exercise base and a foot-driven gear mechanism;

the hand-exercise base being laterally mounted on the front section and the middle section of the bike frame, the hand exercise base including a pair of elliptic rings each having a respective sectional surface and a rack, the sectional surface of each elliptic ring resembles a C-shape with one end extending outwardly therefrom, the rack resembles an elliptic ring shape with one end thereof being equipped with gear teeth, the rack having a pair of sides, both sides of the rack being attached to a pair of positioning ring plates having respective L-sections, the elliptic rings, the rack and the positioning ring plates being secured to one another by bolts;

the hand-driven gear including a housing body and a gear, a pivot disposed through the housing body and the gear, so that a portion of the pivot is located inside the housing body and a portion of the pivot is located outside the housing body, the diameter of the portion of the pivot located inside the housing body being greater than that portion of the pivot located outside of the housing body, the gear being mounted in the housing body, the gear being frictionally pivoted by the pivot for gearing with the gear teeth of the rack of the hand-exercise base;

the foot-exercise mechanism being longitudinally mounted under the main body of the bike frame, the foot-exercise mechanism including a pair of elliptic rings and a rack, each elliptic ring having a respective sectional surface, the sectional surface of each elliptic ring resembles a C-shape with one end thereof extending outwardly therefrom, the rack resembles an elliptic ring shape with one end thereof being equipped with gear teeth, the rack having a pair of sides, both sides of the rack being attached to a pair of positioning ring plates having respective L-sections, the elliptic rings, the rack and the positioning ring plates being secured to one another by bolts;

the foot-driven gear mechanism including a housing body and a gear, a pivot disposed through the housing body and the gear, so that a portion of the pivot is located inside the housing body and a portion of the pivot is located outside the housing body, the diameter of the portion of the pivot located inside the housing body being greater than that portion of the pivot located outside of the housing body, the gear being mounted in the housing body, the gear being frictionally pivoted by the pivot for gearing with the gear teeth of the rack of the foot-exercise base.

2. The multi-functional stationary bike for gymnastic purposes of claim 1, wherein an arc cover body having a sectional surface is provided, the arc cover body being located at the edge of the elliptic rings on the rear side of the hand-exercise base, so as to cover the junction of the hand-exercise base, the sectional surface of the cover body resembles a U-shape having an appropriate elasticity.

3. The multi-functional stationary bike for gymnastic purposes of claim 1, wherein the housing body of the hand-driven gear mechanism and the foot-driven gear mechanism resembles an uncovered rectangular box having an open end an a lateral wall at the open end, at least one long bolt disposed extending through each lateral wall at the open end of the housing body each long bolt having a pair of ends, both ends of each bolt carrying a respective bearing, a washer and a nut thereon for positioning the bearing.

4. The multi-functional stationary bike for gymnastic purposes of claim 1, wherein each gear of the hand-driven gear mechanism and the foot-driven gear mechanism is locked with a guard plate and a bearing inserted in respective opposite lateral walls of the housing body, each guard plate having a greater outer diameter than than of the gear, each bearing being covered by an annual plate which has an U-shaped section including an edge and being locked with the housing body by bolts fixed on the edge thereof.

5. The multi-functional stationary bike for gymnastic purposed of claim 1, wherein an arc connection plate is secured to the tope edge of the foot-exercise base, the connection plate being equipped having two arc holes formed therein along the top thereof.

6. A multi-functional stationary bike, comprising:

a bike frame;

a bike seat carried by the frame for accommodating the user of the bike;

a hand-exercise mechanism mounted on the bike frame, the hand-exercise mechanism including an elliptic-shaped gear track and a hand-driven gear disposed in the gear track, such that when hand-driven, the hand-driven gear moves along the elliptic track in a reciprocating manner for providing the user of the bike with an upper body exercise; and a foot-exercise mechanism mounted on the bike frame, the foot-exercise mechanism including an elliptic-shaped gear track and a foot-driven gear disposed in the gear track, such that when foot-driven, the foot-driven, gear moves along the elliptic track in a reciprocating manner for providing the user of the bike with a lower body exercise.

* * * * *